US009742160B1

(12) United States Patent
Minami

(10) Patent No.: US 9,742,160 B1
(45) Date of Patent: Aug. 22, 2017

(54) MULTIPOINT SPARK PLUG AND MULTIPOINT SPARK PLUG MANUFACTURING METHOD

(71) Applicant: MIYAMA, INC., Nagano (JP)

(72) Inventor: Katsuaki Minami, Nagano (JP)

(73) Assignee: MIYAMA, INC., Nagano-shi (JP)

( * ) Notice: Subject to any disclaimer, the term of this patent is extended or adjusted under 35 U.S.C. 154(b) by 0 days.

(21) Appl. No.: 15/414,937

(22) Filed: Jan. 25, 2017

(30) Foreign Application Priority Data

| | | |
|---|---|---|
| Feb. 9, 2016 | (JP) | 2016-022982 |
| Feb. 9, 2016 | (JP) | 2016-022983 |
| Jun. 13, 2016 | (JP) | 2016-128126 |

(51) Int. Cl.

| | |
|---|---|
| ***H01T 13/46*** | (2006.01) |
| ***H01T 13/22*** | (2006.01) |
| ***H01T 13/08*** | (2006.01) |
| ***H01T 21/02*** | (2006.01) |
| *H01T 13/16* | (2006.01) |
| *H01T 13/18* | (2006.01) |

(52) U.S. Cl.
CPC ..... *H01T 13/462* (2013.01); *H01T 13/08* (2013.01); *H01T 13/22* (2013.01); *H01T 21/02* (2013.01); *H01T 13/16* (2013.01); *H01T 13/18* (2013.01)

(58) Field of Classification Search
CPC ..... H01T 13/22; H01T 13/18; H01T 13/16; H01T 13/08; H01T 13/462; H01T 21/02
USPC ..... 313/123, 141
See application file for complete search history.

(56) References Cited

U.S. PATENT DOCUMENTS

| | | | |
|---|---|---|---|
| 7,441,540 | B1 | 10/2008 | Minami |
| 2006/0028107 | A1 | 2/2006 | Hori et al. |

FOREIGN PATENT DOCUMENTS

| | | |
|---|---|---|
| JP | 57-131868 | 8/1982 |
| JP | 58-180775 | 10/1983 |
| JP | 61-292875 | 12/1986 |
| JP | H2-102336 | 5/1992 |
| JP | 09-219274 | 8/1997 |
| JP | 2001-160475 | 6/2001 |
| JP | 2005-188340 A | 7/2005 |
| JP | 2006-049206 | 2/2006 |
| JP | 2008-218204 | 9/2008 |
| JP | 2009-041366 | 2/2009 |

OTHER PUBLICATIONS

U.S. Appl. No. 15/414,828, filed Jan. 25, 2017.
Extended EP Search Report issued in corresponding EP Patent App. No. 17 154 573.4, dated Jun. 6, 2017.

*Primary Examiner* — Vip Patel
(74) *Attorney, Agent, or Firm* — Greer Burns & Crain Ltd.

(57) ABSTRACT

A multipoint spark plug includes side electrodes provided in a pair so as to extend in a lengthwise direction of a tip end portion via a gap, and an intermediate electrode provided in the gap between the pair of side electrodes such that a plurality of ignition gaps are formed in the lengthwise direction of the tip end portion. An electrode holding portion is formed from separate parts that hold the side electrodes and the intermediate electrode, respectively, so as to insulate the side electrodes and the intermediate electrode from the main body portion, and the respective parts thereof project into the combustion chamber from the tip end portion.

12 Claims, 11 Drawing Sheets

MULTIPOINT SPARK PLUG AND MULTIPOINT SPARK PLUG MANUFACTURING METHOD

TECHNICAL FIELD

The present invention relates to a multipoint spark plug having a plurality of ignition gaps, and a method of manufacturing a multipoint spark plug.

BACKGROUND ART

JP2008-218204A discloses a multipoint spark plug having main body fitting that is inserted into a plug hole of a cylinder head so that a tip end portion thereof opposes a combustion chamber, and a positive electrode, an intermediate electrode, and an earth electrode that are held by an insulating portion and project into the combustion chamber from the insulating portion so as to form a plurality of ignition gaps. In this multipoint spark plug, a heat range can be set by adjusting the depth of a recession formed in a tip end of the insulating portion so as to alter a surface area of the insulating portion that is within the combustion chamber.

SUMMARY OF INVENTION

However, although it is possible with the multipoint spark plug disclosed in JP2008-218204A to set the heat range by adjusting the depth of the recession formed in the insulating portion, it is difficult to adjust the positive electrode, the intermediate electrode, and the earth electrode respectively to desired heat ranges.

An object of the present invention is to provide a multipoint spark plug with which a side electrode and an intermediate electrode can respectively be adjusted to desired heat ranges.

According to one aspect of this invention, a multipoint spark plug configured to ignite an air-fuel mixture in a combustion chamber of an engine, includes: a main body portion formed in a flattened shape, the main body portion being inserted into an insertion hole of the engine such that a tip end portion thereof opposes the combustion chamber; an electrode holding portion provided on the tip end portion; and electrodes held by the electrode holding portion, the electrodes projecting into the combustion chamber from the electrode holding portion so as to form a plurality of ignition gaps. The electrodes include side electrodes and an intermediate electrode, the side electrodes being provided in a pair and disposed via a gap in a lengthwise direction of the tip end portion, the intermediate electrode being provided in the gap between the pair of side electrodes such that the plurality of ignition gaps are formed in the lengthwise direction of the tip end portion. The electrode holding portion is formed from separate parts that hold the side electrodes and the intermediate electrode, respectively, so as to insulate the side electrodes and the intermediate electrode from the main body portion, the electrode holding portion projecting into the combustion chamber from the tip end portion.

DESCRIPTION OF EMBODIMENT

A multipoint spark plug 100 according to an embodiment of the present invention will be described below with reference to the figures.

First, referring to FIGS. 1, 2A, and 2B, a configuration of an engine 1 to which the multipoint spark plug 100 is applied will be described.

Figure 1:
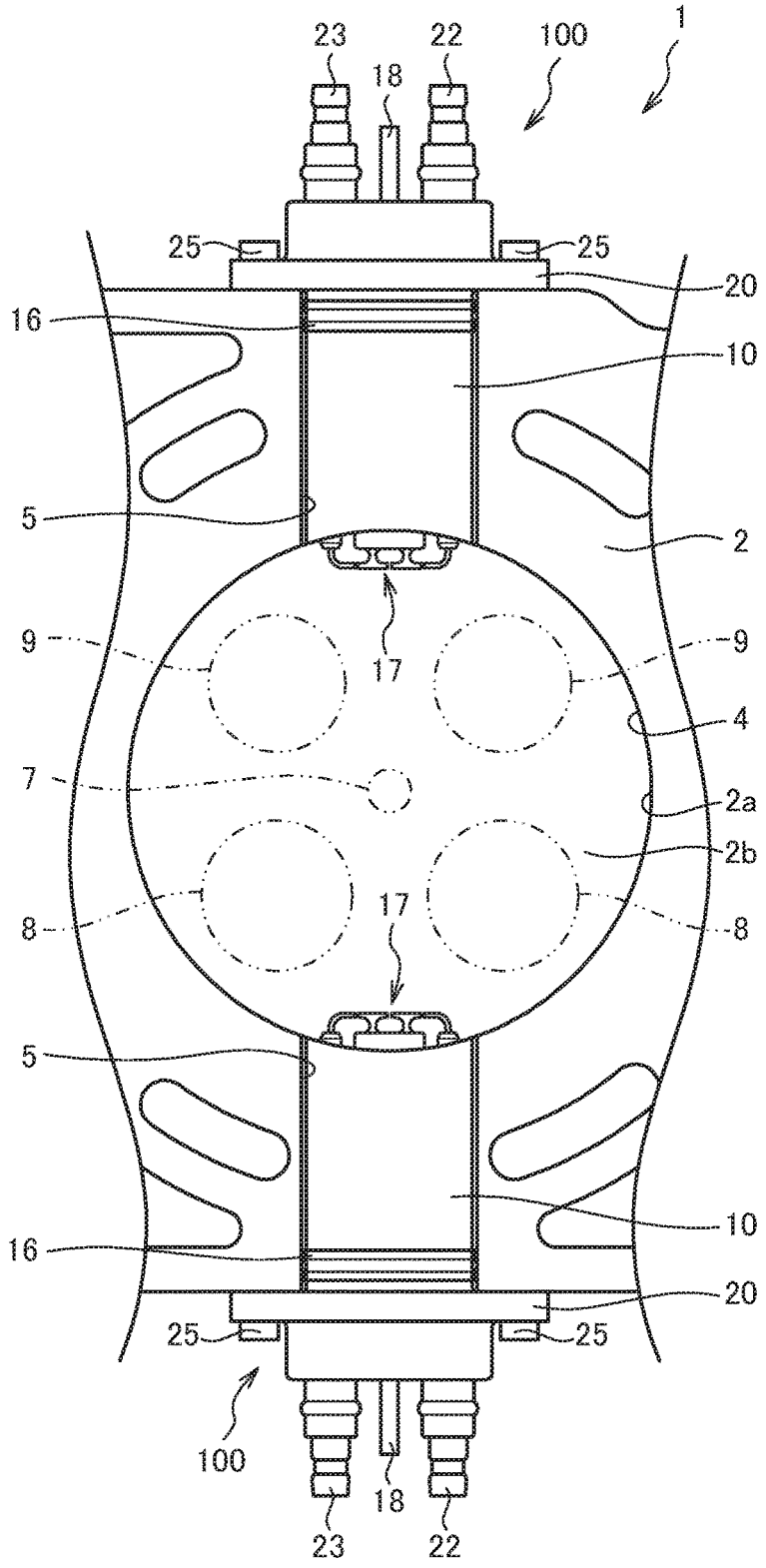
FIG. 1 is a view illustrating an attachment state in which a multipoint spark plug according to an embodiment of the present invention is attached to an engine.
Figure 2A:
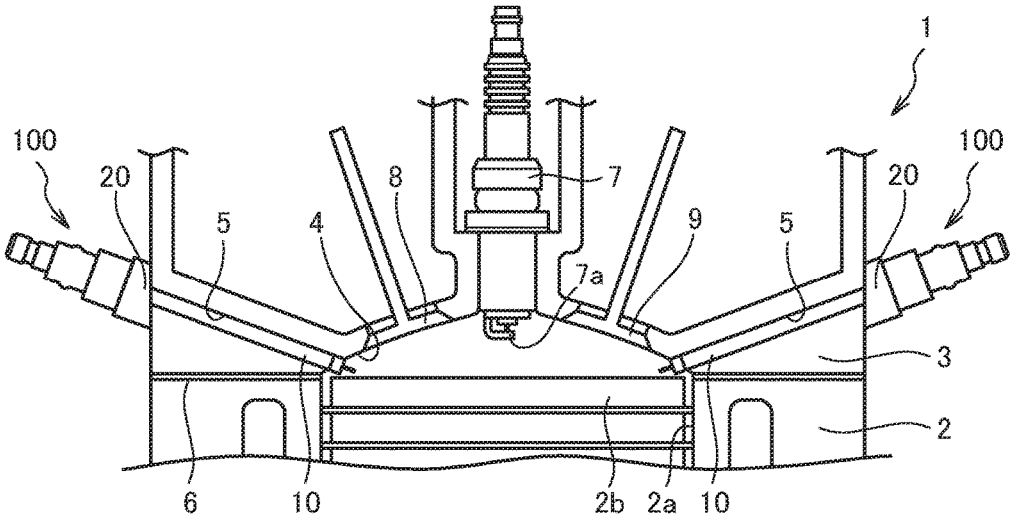
FIG. 2A is a side view of FIG. 1.
Figure 2B:
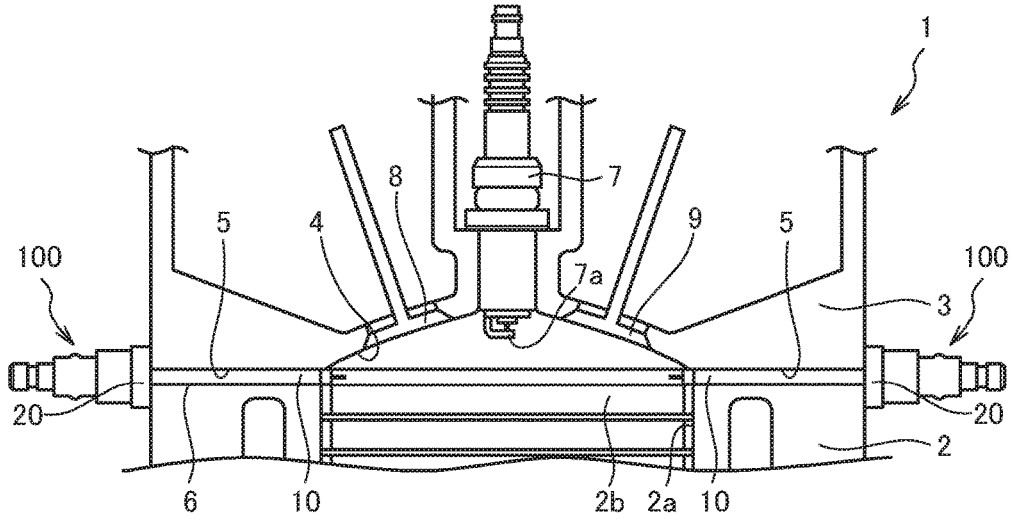
FIG. 2B is a side view illustrating another attachment state in which the multipoint spark plug is attached to the engine.

As shown in FIG. 1, the engine 1 includes a cylinder 2*a* formed in a cylinder block 2, a piston 2*b* that reciprocates through the cylinder 2*a*, and a cylinder head 3 (see FIG. 2A) that is attached to the cylinder block 2 in order to close a top portion of the cylinder 2*a*. A combustion chamber 4 is formed in the engine 1 by the cylinder 2*a*, the piston 2*b*, and the cylinder head 3. The engine 1 is a spark ignition type internal combustion engine that obtains power when the multipoint spark plug 100 ignites a compressed air-fuel mixture in the combustion chamber 4 together with a spark plug 7 so that the air-fuel mixture burns.

The engine 1 includes a pair of insertion holes 5 into which the multipoint spark plug 100 is inserted. As shown in FIG. 2A, the insertion holes 5 are formed in the cylinder head 3. The present invention is not limited to this configuration, and as shown in FIG. 2B, the insertion holes 5 may be formed in a head gasket 6 provided between the cylinder block 2 and the cylinder head 3. Further, although not shown in the figures, the insertion holes 5 may be formed in the cylinder block 2. In other words, the insertion holes 5 are formed in any part of the engine 1 into which the multipoint spark plug 100 can be inserted.

In the engine 1, the insertion holes 5 are respectively formed in positions removed from the spark plug 7 on an intake valve 8 side and an exhaust valve 9 side of the combustion chamber 4 (in a lower end portion of the combustion chamber 4). In the engine 1, ignition is performed by the multipoint spark plug 100 as well as the spark plug 7, and therefore a flame motion can be generated during combustion. Hence, fast combustion can be realized without providing a squish area, and as a result, cooling loss can be reduced.

It should be noted that the present invention is not limited to this configuration, and instead, the insertion holes 5 may be formed away from the spark plug 7 in locations within the combustion chamber 4 where the temperature of the air-fuel mixture is low, or in other words locations where knocking is likely to occur. Further, the insertion hole 5 may be formed in a single location within the combustion chamber 4, or in a plurality of three or more locations. By forming the insertion holes 5 in accordance with the shape of the combustion chamber 4 in this manner, a desired number of multipoint spark plugs 100 can be provided.

Next, referring to FIGS. 3 and 4, a configuration of the multipoint spark plug 100 will be described.

Figure 3:
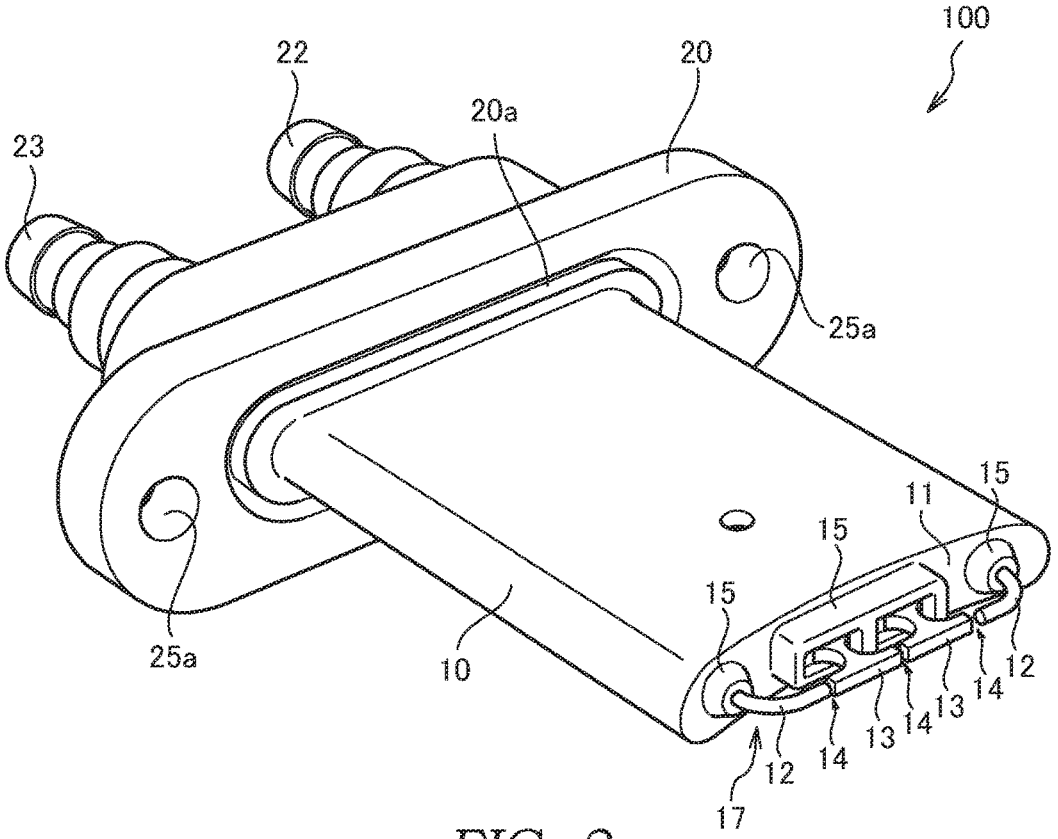
FIG. 3 is a perspective view of the multipoint spark plug.
Figure 4:
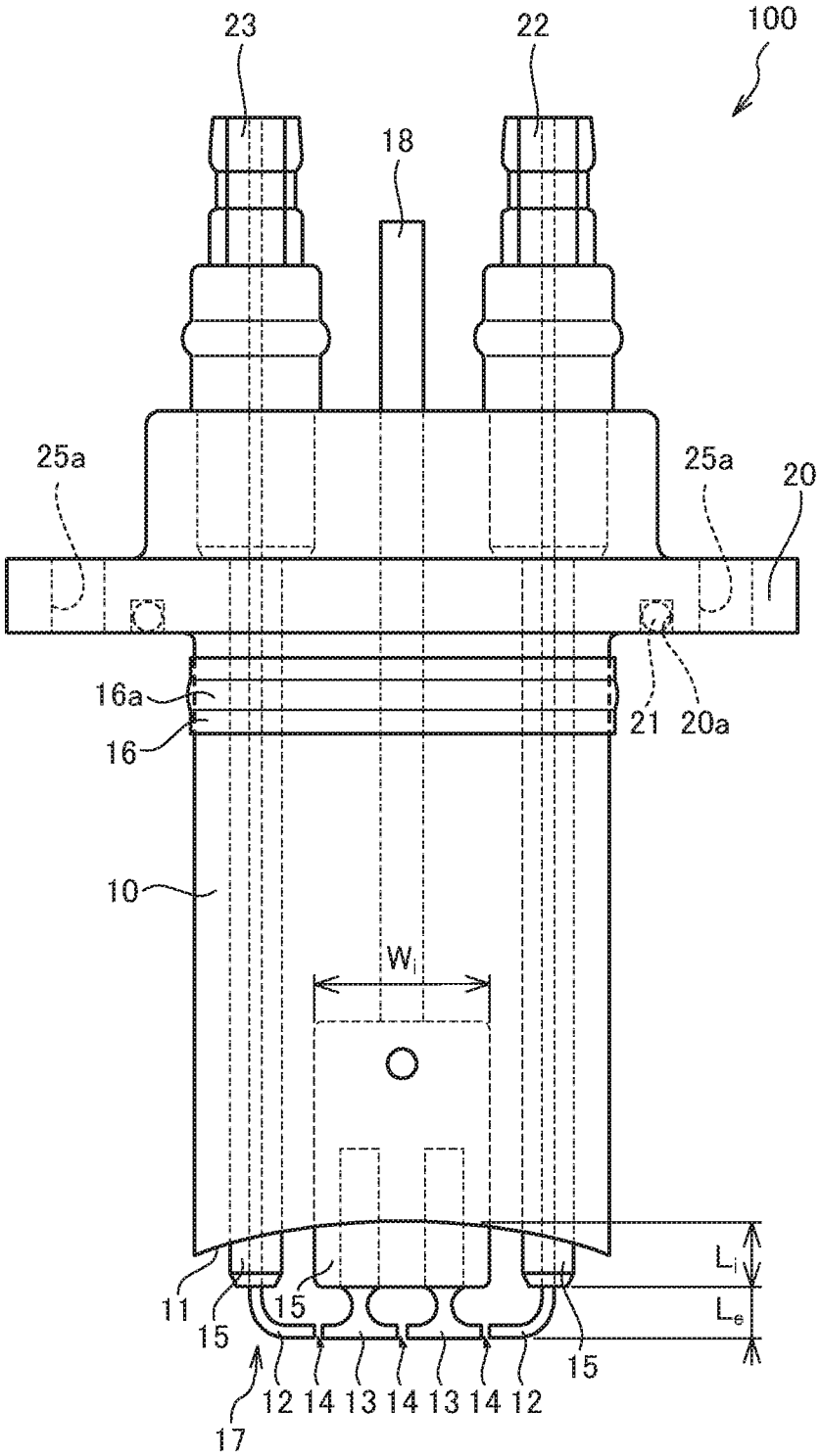
FIG. 4 is a plan view of FIG. 3.

As shown in FIGS. 3 and 4, the multipoint spark plug 100 includes a main body portion 10 that is formed in a flattened shape and inserted into the insertion hole 5 in the cylinder head 3 so that a tip end portion 11 thereof opposes the combustion chamber 4, an insulator 15 serving as an electrode holding portion that is provided so as to project into the combustion chamber 4 from the tip end portion 11, electrodes 17 that are held by the insulator 15 and project further into the combustion chamber 4 from the insulator 15 so as to form a plurality of ignition gaps 14, a temperature adjustment unit 18 that adjusts the temperature of the multipoint spark plug 100, and a flange portion 20 that is formed to be larger than the main body portion 10 and serves as an attachment portion that is attached to the cylinder head 3.

The main body portion 10 has a rounded rectangle-shaped cross-section corresponding to the shape of the insertion hole 5, and is formed at a length corresponding to the insertion hole 5. The main body portion 10 is formed from a metal such as aluminum. By forming the main body portion 10 a flattened shape, a surface area of the multipoint spark plug 100 that is within the combustion chamber 4 can be reduced in comparison with a case where the electrodes 17 forming the plurality of ignition gaps 14 are provided and the main body portion 10 is not formed in a flattened shape. As a result, the multipoint spark plug 100 can be disposed in the combustion chamber 4 with a greater degree of freedom.

As shown in FIG. 4, a metal gasket 16 is wound around the main body portion 10 as a first sealing material that closes a gap between the main body portion 10 and the insertion hole 5. The metal gasket 16 will be described in further detail below.

The tip end portion 11 is formed in an identical shape to an inner periphery of the combustion chamber 4, and forms a part of the inner periphery of the combustion chamber 4. More specifically, the tip end portion 11 is formed in a spherical surface shape that has an identical radius to the hemispherical combustion chamber 4 when the multipoint spark plug 100 is attached to the cylinder head 3 in which the hemispherical combustion chamber 4 is provided. Further, the tip end portion 11 is formed in a curved surface shape that has an identical radius to an inner periphery of the cylinder 2*a* when the multipoint spark plug 100 is attached to the head gasket 6.

The electrodes 17 include side electrodes 12 provided in a pair and disposed via a gap in a lengthwise direction of the tip end portion 11, and intermediate electrodes 13 provided in the gap between the pair of side electrodes 12 so as to form the plurality of ignition gaps 14 in the lengthwise direction of the tip end portion 11. As shown in FIG. 4, a projection length by which the electrodes 17 project from a tip end of the insulator 15 is set at $L_e$.

The side electrodes 12 are held on the main body portion 10 via the insulator 15. The side electrodes 12 project further into the combustion chamber 4 from the insulator 15. The side electrodes 12 are formed so as to project from the tip end portion 11 in an L shape. One of the side electrodes 12 (a first side electrode 12) penetrates the main body portion 10 and the flange portion 20 so as to extend to an input terminal 22, to be described below. The other side electrode 12 (a second side electrode 12) penetrates the main body portion 10 and the flange portion 20 similarly so as to extend to a connection terminal 23, to be described below. The pair of side electrodes 12 are provided so that respective tip ends thereof face each other. An ignition current from an ignition coil (not shown) is input into the first side electrode 12 via the input terminal 22.

The intermediate electrodes 13 are provided in a pair and disposed between the pair of mutually opposing side electrodes 12. The intermediate electrodes 13 are held on the main body portion 10 via the insulator 15. The intermediate electrodes 13 project further into the combustion chamber 4 from the insulator 15. In contrast to the side electrodes 12, the intermediate electrodes 13 do not penetrate the main body portion 10. Instead, the intermediate electrodes 13 are held on the main body portion 10 by being inserted partially therein.

The intermediate electrodes 13 are disposed in a straight line so as to form three ignition gaps 14 at equal intervals between the pair of mutually opposing side electrodes 12. By forming the plurality of ignition gaps 14 in the tip end portion 11 of the flattened main body portion 10 so as to extend in the lengthwise direction in this manner, multipoint ignition can be implemented over a wide range of the combustion chamber 4.

The intermediate electrode 13 may be provided singly, or in a plurality of three or more. The number of intermediate electrodes 13 may be set as desired in accordance with a lengthwise direction dimension of the tip end portion 11 of the main body portion 10, a designed number of ignition gaps 14, and so on.

The intermediate electrodes 13 are formed so as to project from the tip end portion 11 in a T shape. In so doing, the ignition current input into the first side electrode 12 from the ignition coil can pass through the ignition gaps 14 in a straight line and flow into the second side electrode 12. As a result, sparks can be generated reliably in the ignition gaps 14.

The insulator 15 insulates the side electrodes 12 and the intermediate electrodes 13 from the main body portion 10. Parts of the insulator 15 that hold the side electrodes 12 and a part thereof that holds the intermediate electrodes 13 are formed separately. Accordingly, respective surface areas within the combustion chamber 4 of the parts that hold the side electrodes 12 and the part that holds the intermediate electrodes 13 can be adjusted individually, and as a result, each of the parts that project into the combustion chamber 4 can be adjusted to a desired heat range.

The parts of the insulator 15 that hold the side electrodes 12 project partially from the tip end portion 11, and are formed to be long enough to penetrate the main body portion 10 and the flange portion 20. The part of the insulator 15 that holds the intermediate electrodes 13 projects partially from the tip end portion 11, and is formed at a size enabling a part thereof to be inserted into the interior of the main body portion 10. As shown in FIG. 4, a projection length of the part of the insulator 15 that projects furthest from the tip end portion 11 is set at $L_i$, and a projection width of the part of the insulator 15 that holds the intermediate electrodes 13 is set at $W_i$.

As shown in FIG. 1, the metal gasket 16 is wound around the outer periphery of the main body portion 10 of the multipoint spark plug 100 when the main body portion 10 is to be inserted into the insertion hole 5. As a result, the metal gasket 16 seals the gap between the main body portion 10 and the insertion hole 5 when the multipoint spark plug 100 is attached. The metal gasket 16 is formed from a metal material. As shown in FIG. 4, the metal gasket 16 includes a bead portion 16*a* that projects in an annular shape around an outer periphery thereof.

As shown in FIG. 4, the temperature adjustment unit 18 penetrates the flange portion 20 and the main body portion 10 of the multipoint spark plug 100 so as to be connected to the part of the insulator 15 holding the intermediate electrodes 13. The temperature adjustment unit 18 has one or both of a function for warming the multipoint spark plug 100 and a function for cooling the multipoint spark plug 100.

In a case where the multipoint spark plug 100 is to be warmed, a heating device (not shown) such as a heater that generates heat when a current is supplied thereto from a power supply (not shown), for example, is connected to the temperature adjustment unit 18. In a case where the multipoint spark plug 100 is to be cooled, a cooling device (not shown) such as a Peltier device that transfers heat generated by the insulator 15 to the outside when a current is supplied thereto from a power supply, for example, is connected to the temperature adjustment unit 18. The present invention is not limited to these configurations, and instead, a heating device or a cooling device may be inserted directly into the main body portion 10 as the temperature adjustment unit 18.

The flange portion 20 is formed around the entire periphery of the main body portion 10 so as to project from the main body portion 10 toward the outer periphery. The flange portion 20 is formed integrally with the main body portion 10 from a metal such as aluminum. The flange portion 20 includes a pair of fastening holes 25*a*. The flange portion 20 is fastened to an outer surface of the cylinder head 3 by a pair of bolts 25 inserted into the fastening holes 25*a*. An O-ring 21 is provided on the flange portion 20 as a second sealing material that seals a contact surface between the flange portion 20 and the cylinder head 3.

The O-ring 21 is inserted into an O-ring groove 20*a* formed in an annular shape in a surface of the flange portion 20 that opposes the main body portion 10. The O-ring 21 is formed from a rubber material. The O-ring 21 is compressed between the flange portion 20 and the cylinder head 3 by a fastening force of the bolts 25 so as to seal the gap between the main body portion 10 and the insertion hole 5.

The flange portion 20 includes the input terminal 22, which is connected to the first side electrode 12 and receives the ignition current from the ignition coil, and the connection terminal 23, which is connected to the second side electrode 12 and to the input terminal 22 of another multipoint spark plug 100.

As a result, a pair of the multipoint spark plugs 100 provided in the single combustion chamber 4 can be connected in series via a plug cord (not shown) so as to perform ignition simultaneously. Further, the spark plugs 7 can be connected in series at respective ends of the pair of multipoint spark plugs 100 via a plug cord (not shown) so as to perform ignition simultaneously. At this time, earth electrodes 7*a* (see FIG. 2A) of the spark plugs 7 are earthed by being brought into contact with the cylinder head 3.

A method of manufacturing the multipoint spark plug 100 (a heat range setting method) will now be described.

First, referring to FIGS. 5 to 7, a method of setting the heat range of the multipoint spark plug 100 by varying respective surface areas within the combustion chamber 4 of the electrodes 17 and the insulator 15 will be described.

Figure 5:
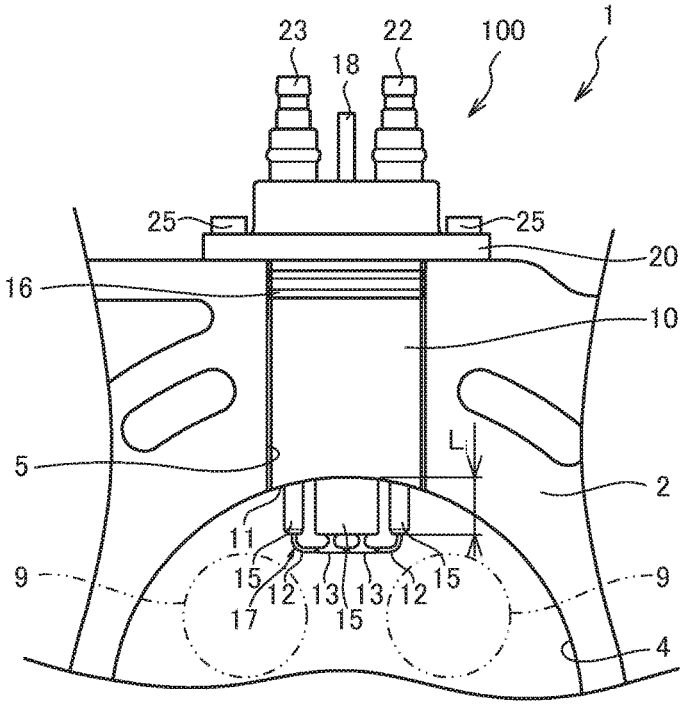
FIG. 5 is a view illustrating an attachment state in which the multipoint spark plug is attached to the engine after being set at a low heat range by varying projection lengths by which the electrode holding portions respectively project into a combustion chamber.

In the multipoint spark plug 100 shown in FIG. 5, the projection length $L_i$ of the insulator 15 is set to be greater than that of the multipoint spark plug 100 shown in FIG. 1. In other words, a greater surface area of the insulator 15 is within the combustion chamber 4. Accordingly, a greater surface area of the insulator 15 is exposed to the flame within the combustion chamber 4, and therefore the temperatures of the electrodes 17 are more likely to increase. As a result, the heat range of the multipoint spark plug 100 shown in FIG. 5 is lower than that of the multipoint spark plug shown in FIG. 1.

Hence, in the multipoint spark plug 100, the surface area of the insulator 15 that is within the combustion chamber 4 is set by varying the projection length $L_i$ of the insulator 15. More specifically, as the projection length $L_i$ of the insulator 15 increases, the heat range of the multipoint spark plug 100 decreases, and as the projection length $L_i$ of the insulator 15 decreases, the heat range of the multipoint spark plug 100 increases. As a result, the heat range of the multipoint spark plug 100 can be adjusted by varying the projection length $L_i$ of the insulator 15.

Figure 6:
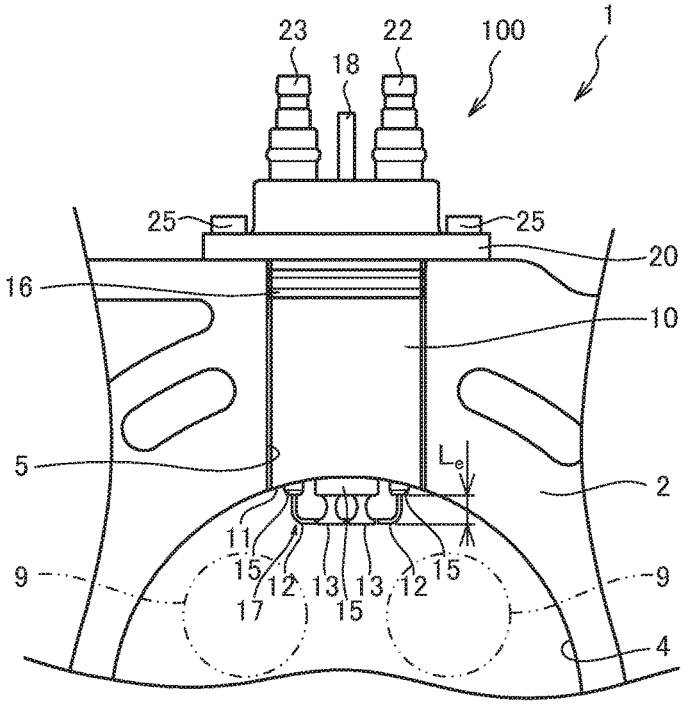
FIG. 6 is a view illustrating an attachment state in which the multipoint spark plug is attached to the engine after being set at a low heat range in accordance with projection lengths by which the electrodes respectively project into the combustion chamber.

In the multipoint spark plug 100 shown in FIG. 6, the projection length $L_e$ of the electrodes 17 is set to be greater than that of the multipoint spark plug 100 shown in FIG. 1. In other words, a greater surface area of the electrodes 17 is within the combustion chamber 4. Accordingly, a greater surface area of the electrodes 17 is exposed to the flame within the combustion chamber 4, and therefore the temperatures of the electrodes 17 are more likely to increase. As a result, the heat range of the multipoint spark plug 100 shown in FIG. 6 is lower than that of the multipoint spark plug shown in FIG. 1.

Hence, in the multipoint spark plug 100, the surface area of the electrodes 17 that is within the combustion chamber 4 is set by varying the projection length $L_e$ of the electrodes 17. More specifically, as the projection length $L_e$ of the electrodes 17 increases, the heat range of the multipoint spark plug 100 decreases, and as the projection length $L_e$ of the electrodes 17 decreases, the heat range of the multipoint spark plug 100 increases. As a result, the heat range of the multipoint spark plug 100 can be adjusted by varying the projection length $L_e$ of the electrodes 17.

It should be noted that in the multipoint spark plugs 100 shown in FIGS. 5 and 6, the tip ends of the electrodes 17 are close to the center of the combustion chamber 4, which is the part of the combustion chamber 4 that reaches the highest temperature. Therefore, the temperatures of the electrodes 17 are more likely to increase not only in accordance with differences in the surface areas of the electrodes 17 and the insulator 15, but also in accordance with the positions of the tip ends of the electrodes 17 within the combustion chamber 4.

Figure 7:
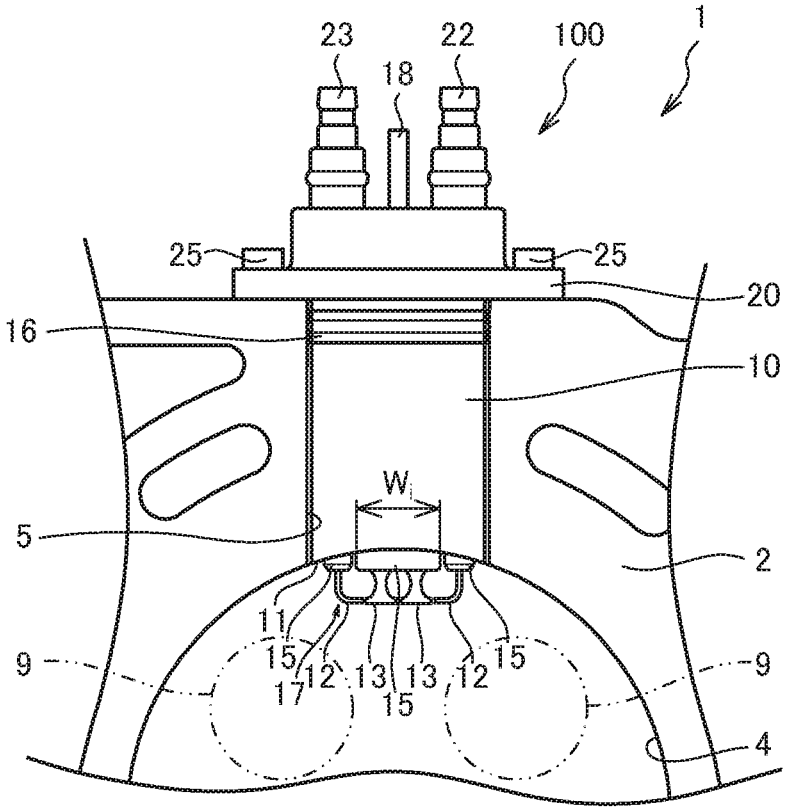
FIG. 7 is a view illustrating an attachment state in which the multipoint spark plug is attached to the engine after being set at a low heat range in accordance with projection widths by which the electrode holding portions respectively project into the combustion chamber.

In the multipoint spark plug 100 shown in FIG. 7, the projection width $W_i$ of the part of the insulator 15 that holds the intermediate electrodes 13 is set to be greater than that of the multipoint spark plug 100 shown in FIG. 1. The projection width of the parts of the insulator 15 that hold the side electrodes 12 are likewise increased. In other words, a greater surface area of the insulator 15 is within the combustion chamber 4. Accordingly, a greater surface area of the insulator 15 is exposed to the flame within the combustion chamber 4, and therefore the temperatures of the electrodes 17 are more likely to increase. As a result, the heat range of the multipoint spark plug 100 shown in FIG. 7 is lower than that of the multipoint spark plug shown in FIG. 1.

Hence, in the multipoint spark plug 100, the surface area of the insulator 15 that is within the combustion chamber 4 is set by varying the projection width $W_i$ of the insulator 15. More specifically, as the projection width $W_i$ of the insulator 15 increases, the heat range of the multipoint spark plug 100 decreases, and as the projection width $W_i$ of the insulator 15 decreases, the heat range of the multipoint spark plug 100 increases. As a result, the heat range of the multipoint spark plug 100 can be adjusted by varying the projection width $W_i$ of the insulator 15.

Hence, in the multipoint spark plug 100, the insulator 15 projects into the combustion chamber 4 from the tip end portion 11 of the main body portion 10, and the electrodes 17 project further into the combustion chamber 4 from the insulator 15. In the multipoint spark plug 100, therefore, the heat range is set by varying the surface area within the combustion chamber 4 of at least one of the insulator 15 and the electrodes 17. As a result, the parts that project into the combustion chamber 4 have a large surface area, and therefore the heat range can be adjusted over a wide range.

It should be noted that the heat range of the multipoint spark plug 100 is modified by preparing a plurality of multipoint spark plugs 100 having different heat ranges in advance, and attaching the multipoint spark plug 100 having the desired heat range.

Next, referring to FIG. 8, adjustment of the heat range of the multipoint spark plug 100 using the temperature adjustment unit 18 will be described.

Figure 8:
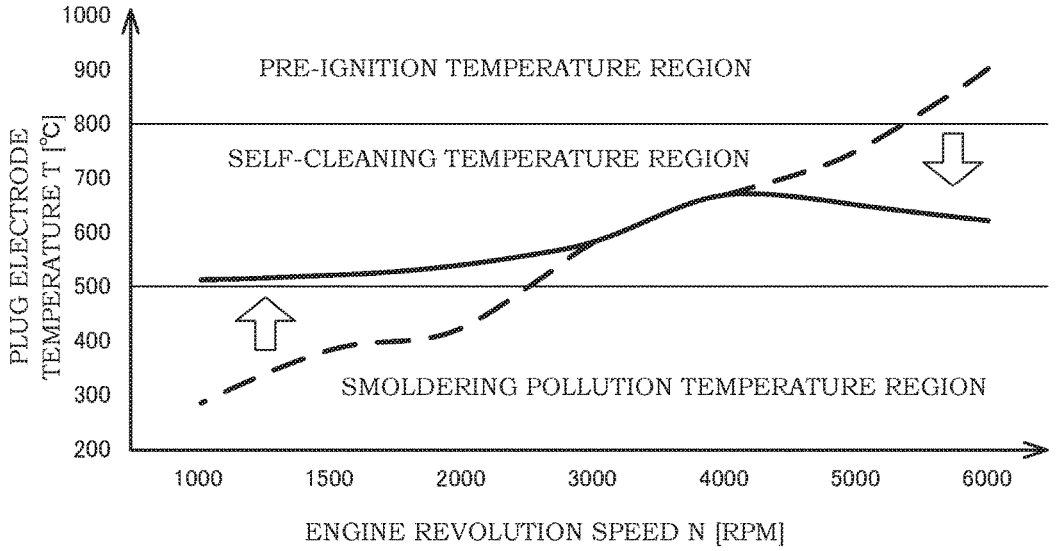
FIG. 8 is a view illustrating adjustment of the temperature of the multipoint spark plug, which is executed by a temperature adjustment portion.

In FIG. 8, the abscissa shows the engine revolution speed N [rpm] and the ordinate shows the temperature T [° C.] of the electrodes 17 of the multipoint spark plug 100. In FIG. 8, a dotted line shows a relationship between the engine revolution speed N and the temperature T of the electrodes 17 in a case where the temperature adjustment unit 18 is not provided, and a solid line shows the relationship between the engine revolution speed N and the temperature T of the electrodes 17 in a case where the temperature adjustment unit 18 is provided.

In the multipoint spark plug 100, as shown in FIG. 8, when the temperature T of the electrodes 17 falls below a self-cleaning temperature (approximately 500 [° C.]), the fuel does not undergo perfect combustion, and therefore carbon generated as a result adheres to the vicinity of the electrodes 17 (a smoldering pollution temperature region). When the temperature T of the electrodes 17 increases excessively (above approximately 800 [° C.]), on the other hand, the electrodes 17 themselves become heat sources such that pre-ignition occurs, with the result that sparks are generated before sparks fly from the ignition gaps 14 (a pre-ignition temperature region). Hence, the multipoint spark plug 100 is preferably used in a state where the temperature T of the electrodes 17 is within an appropriate range (a self-cleaning temperature region) of approximately 500 to 800 [° C.].

In the engine 1 to which the multipoint spark plug 100 is applied, in contrast to an engine in which the spark plug 7 is provided alone such that single-point ignition is implemented, operations can be performed in a wide air-fuel ratio A/F range of approximately 12 to 25, and as a result, lean burn can be realized. To enable operations in this wide A/F range, the multipoint spark plug 100 must be compatible with a wide temperature range.

In the multipoint spark plug 100, therefore, when the engine revolution speed N is comparatively low such that the temperature T of the electrodes 17 falls below the self-cleaning temperature, the heating device warms the insulator 15 and the electrodes 17 via the temperature adjustment unit 18, thereby increasing the temperature T of the electrodes 17 to the self-cleaning temperature region. When the engine revolution speed N is comparatively high such that the temperature T of the electrodes 17 enters the pre-ignition temperature region, on the other hand, the cooling device cools the insulator 15 and the electrodes 17 via the temperature adjustment unit 18, thereby reducing the temperature T of the electrodes 17 to the self-cleaning temperature region. In so doing, the heat range of the multipoint spark plug 100 can be adjusted, and as a result, the temperature T of the electrodes 17 can be maintained within an appropriate range in all regions of the engine revolution speed N.

It should be noted that the present invention is not limited to this configuration, and the heat range of the multipoint spark plug 100 may be set in advance so as never to reach the pre-ignition temperature region, even at a maximum. In this case, the heating device warms the insulator 15 and the electrodes 17 via the temperature adjustment unit 18 only when the temperature T of the electrodes 17 falls below the self-cleaning temperature. Alternatively, the heat range of the multipoint spark plug 100 may be set in advance so as never to fall below the self-cleaning temperature, even at a minimum. In this case, the cooling device cools the insulator 15 and the electrodes 17 via the temperature adjustment unit 18 only when the temperature T of the electrodes 17 increases excessively.

Further, the temperature within the combustion chamber 4 is typically low in the vicinity of the intake valve 8 and high in the vicinity of the exhaust valve 9. Therefore, when the multipoint spark plug 100 is provided in a pair, as shown in FIG. 1, the heating device may be connected to the temperature adjustment unit 18 of the multipoint spark plug 100 provided on the side close to the intake valve 8 in order to warm the insulator 15 and the electrodes 17, and the cooling device may be connected to the temperature adjustment unit 18 of the multipoint spark plug 100 provided on the side close to the exhaust valve 9 in order to cool the insulator 15 and the electrodes 17.

According to the embodiment described above, following effects are obtained.

In the multipoint spark plug 100, the parts of the insulator 15 that hold the side electrodes 12 and the part of the insulator 15 that holds the intermediate electrodes 13 are formed separately. Therefore, respective surface areas within the combustion chamber 4 of the parts of the insulator 15 that hold the side electrodes 12 and the part of the insulator 15 that holds the intermediate electrodes 13 can be adjusted individually, and as a result, each of the parts that project into the combustion chamber 4 can be adjusted to a desired heat range.

Further, in the multipoint spark plug 100, the insulator 15 projects into the combustion chamber 4 from the tip end portion 11 of the main body portion 10, and the electrodes 17 project further into the combustion chamber 4 from the insulator 15. Therefore, the part that projects into the combustion chamber 4 has a large surface area, and as a result, the heat range can be adjusted over a wide range by varying the surface area within the combustion chamber 4 of at least one of the insulator 15 and the electrodes 17.

Next, referring to FIGS. 9 to 12, configurations of the multipoint spark plug 100 according to first to third modified examples of this embodiment of the present invention will be described.

Figure 9:
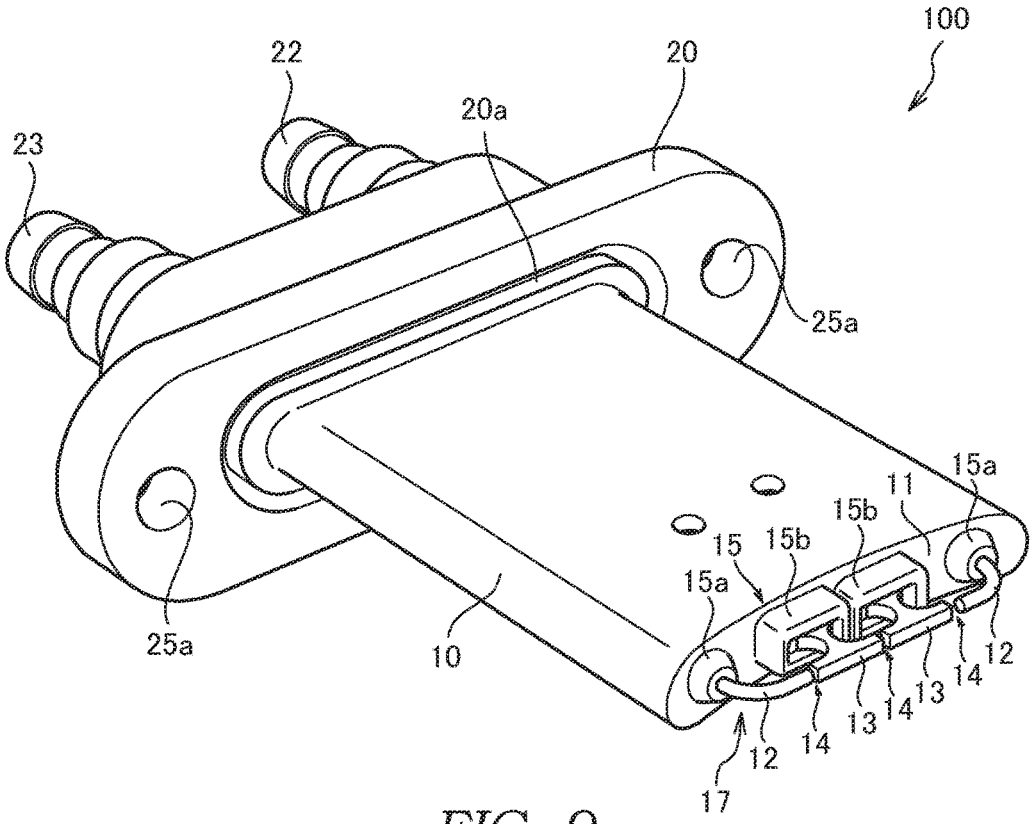
FIG. 9 is a perspective view showing a multipoint spark plug according to a first modified example of this embodiment of the present invention.
Figure 10:
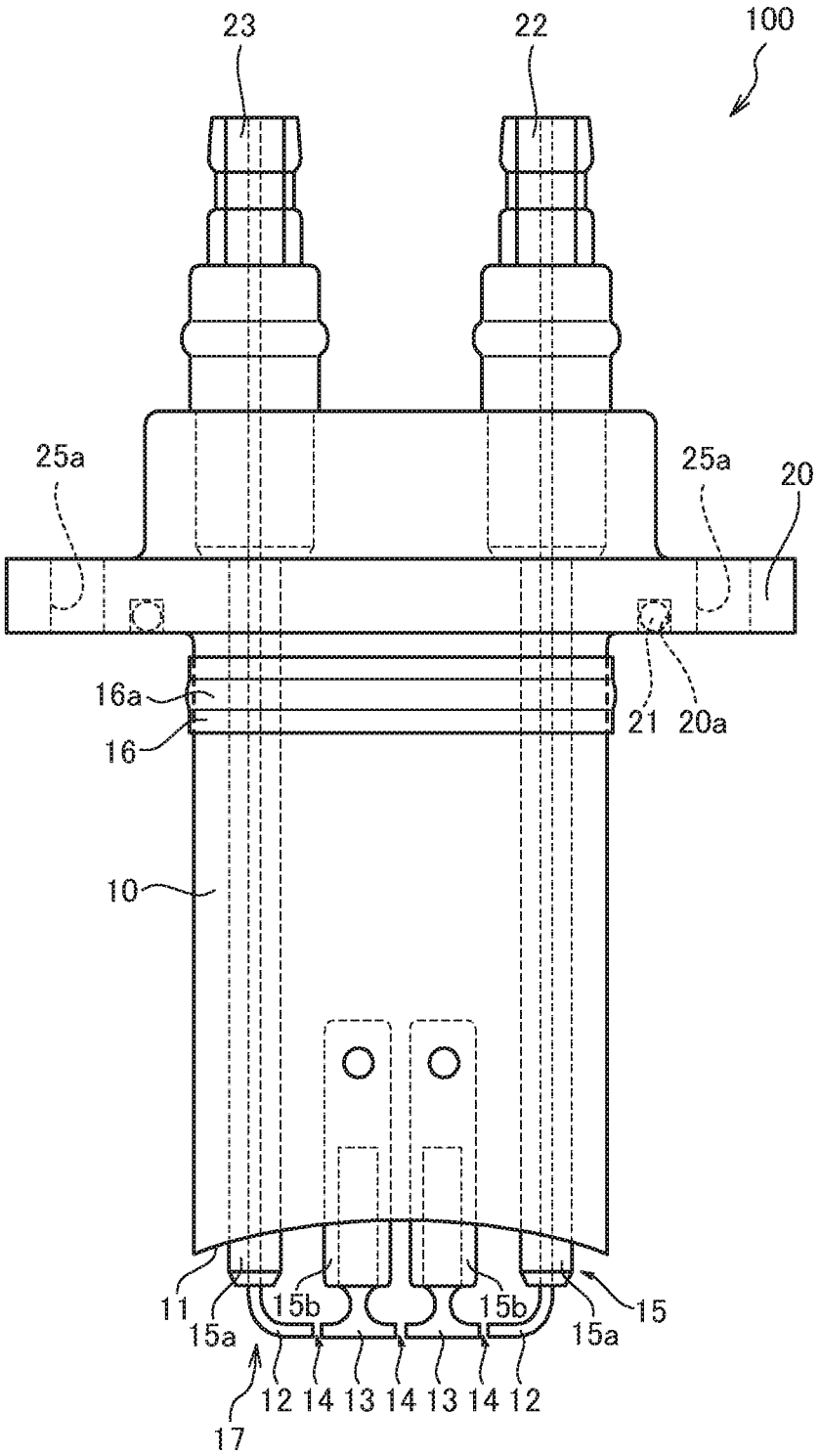
FIG. 10 is a plan view of FIG. 9.

In a first modified example shown in FIG. 9, the insulator 15 includes side insulators 15*a* serving as side electrode holding portions that project into the combustion chamber 4 from the tip end portion 11 and hold the respective side electrodes 12 so as to insulating the side electrodes 12 from the main body portion 10, and intermediate insulators 15*b* serving as intermediate electrode holding portions that project into the combustion chamber 4 from the tip end portion 11 and are formed separately so as to hold the respective intermediate electrodes 13 while insulating the intermediate electrodes 13 from the main body portion 10.

The side insulators 15*a* project partially from the tip end portion 11, and are formed to be long enough to penetrate the main body portion 10 and the flange portion 20.

The intermediate insulators 15*b* project partially from the tip end portion 11, and are formed at a size enabling respective parts thereof to be inserted into the interior of the main body portion 10. The intermediate insulators 15*b* each hold one of the plurality of intermediate electrodes 13, and are therefore provided in an identical number to the intermediate electrodes 13. The present invention is not limited to this configuration, and instead, for example, each one of the pair of intermediate insulators 15*b* may hold two intermediate electrodes 13.

Hence, the side insulators 15*a* and the intermediate insulators 15*b* project into the combustion chamber 4 from the tip end portion 11 of the main body portion 10 formed in a flattened shape, while the side electrodes 12 and the intermediate electrodes 13 project further into the combustion chamber 4 therefrom. The side insulators 15*a* are provided in a pair, each one of which holds one of the side electrodes 12, and the intermediate insulators 15*b* are divided into a plurality, each one of which holds one of the intermediate electrodes 13. Accordingly, respective surface areas within the combustion chamber 4 of the side insulators 15*a*, the intermediate insulators 15*b*, the side electrodes 12, and the intermediate electrodes 13 can be adjusted individually, and as a result, the side electrodes 12 and the intermediate electrodes 13 can respectively be adjusted to desired heat ranges within the multipoint spark plug 100.

Figure 11:
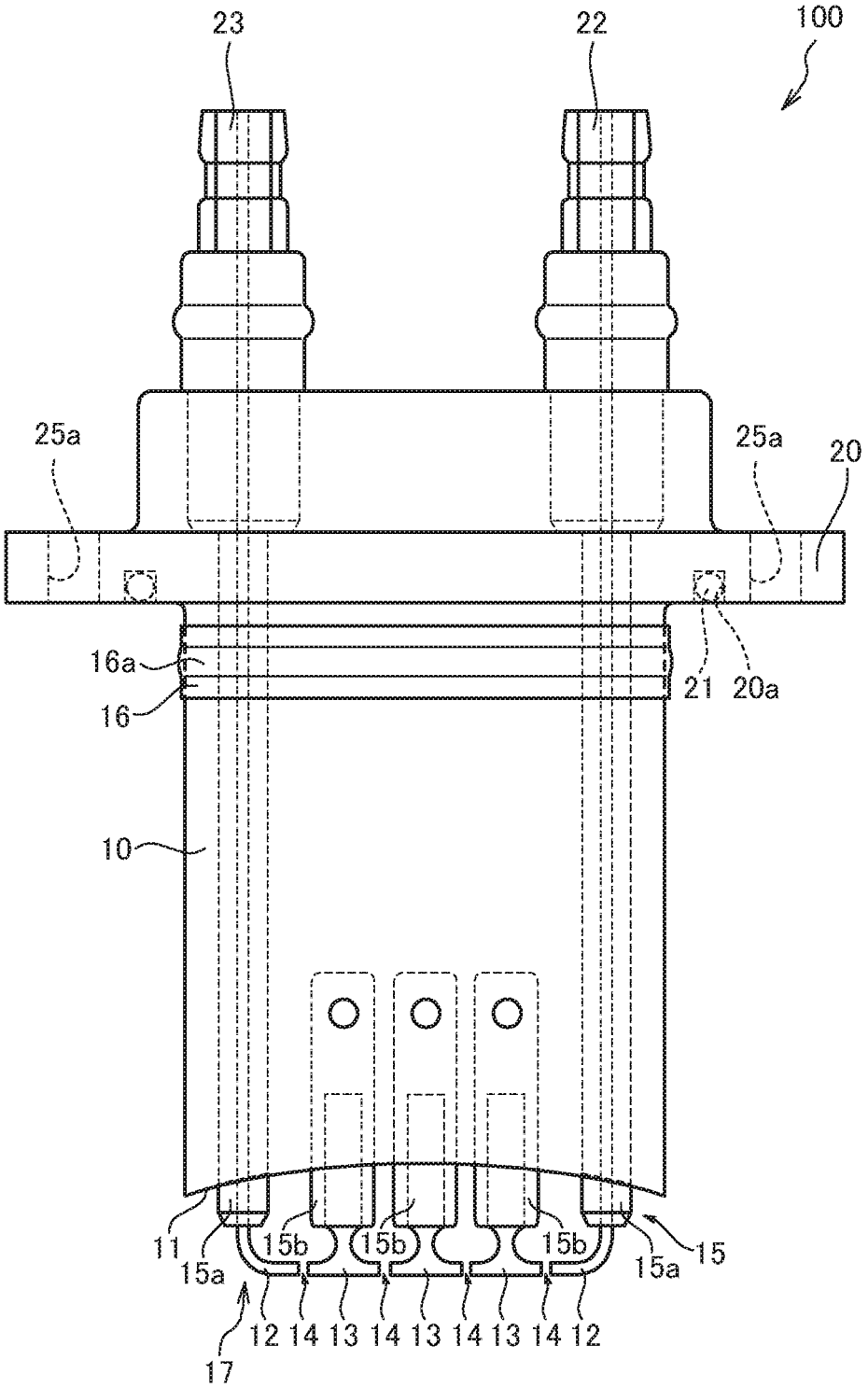
FIG. 11 is a plan view showing a multipoint spark plug according to a second modified example of this embodiment of the present invention.

Three intermediate electrodes 13 may be provided, as in a second modified example shown in FIG. 11. For example, when the combustion chamber 4 has a large inner diameter (bore diameter), multipoint ignition must be performed over a larger area in order to realize fast combustion. In this modified example, therefore, the number of ignition gaps 14 is increased by increasing the number of intermediate electrodes 13. Hence, the intermediate electrode 13 is not limited to a pair, and may be provided in a plurality of three or more. The number of intermediate electrodes 13 is set as desired in accordance with the lengthwise direction dimension of the tip end portion 11 of the main body portion 10, the designed number of ignition gaps 14, and so on.

Figure 12:
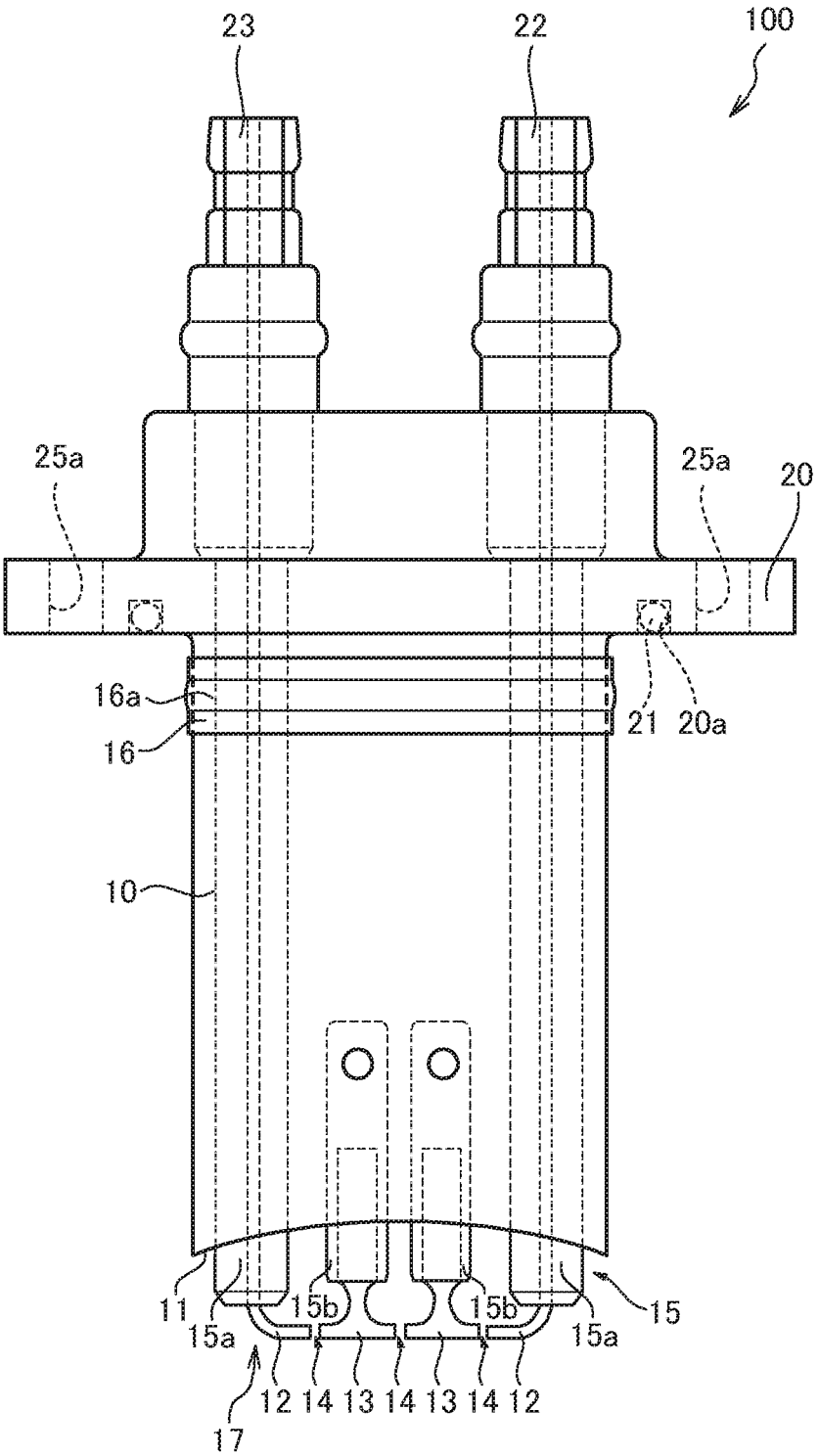
FIG. 12 is a plan view showing a multipoint spark plug according to a third modified example of this embodiment of the present invention.

Further, a total surface area within the combustion chamber 4 of one of the side electrodes 12 and the side insulator 15*a* that holds the side electrode 12 may be set to be larger than a total surface area within the combustion chamber 4 of one of the intermediate electrodes 13 and the intermediate insulator 15*b* that holds the intermediate electrode, as in a third modified example shown in FIG. 12. In this modified example, the total surface area of the side electrode 12 and the side insulator 15 is increased by increasing the diameter of the side insulator 15*a* and providing the side insulator 15*a* so as to project from the tip end portion 11 by a larger amount than the intermediate insulator 15*b*.

When the plurality of ignition gaps 14 are arranged in series, as in the multipoint spark plug 100, the temperature near the respective ends does not increase as easily as the temperature near the center. Therefore, the total surface area that is exposed to the flame in the side electrodes 12 and side insulators 15*a* disposed near the respective ends of the multipoint spark plug 100 is increased. In so doing, the heat ranges of the side electrodes 12 are set to be lower than the heat ranges of the intermediate electrodes 13.

Likewise with the first to third modified examples described above, the respective surface areas within the combustion chamber 4 of the side insulators 15*a* that hold the side electrodes 12 and the intermediate insulators 15*b* that hold the intermediate electrodes 13 can be adjusted individually, and as a result, each of the parts that project into the combustion chamber 4 can be adjusted to a desired heat range.

Embodiments of this invention were described above, but the above embodiments are merely examples of applications of this invention, and the technical scope of this invention is not limited to the specific constitutions of the above embodiments.

For example, in the above embodiment, the temperature adjustment unit 18 is provided in the multipoint spark plug 100, but the present invention is not limited to this configuration, and the temperature adjustment unit 18 may be provided in the spark plug 7 that performs single-point ignition. Likewise in this case, the heat range of the spark plug 7 can be adjusted by having the heating device or the cooling device heat or cool the electrodes of the spark plug 7 via the temperature adjustment unit 18.

Further, in the above embodiment, the main body portion 10 and the flange portion 20 are formed integrally from a metal such as aluminum, and the insulator 15, which is formed from an insulating material such as a ceramic, is inserted therein. Instead, however, the main body portion 10 and the insulator 15 may be formed integrally from an insulating material such as a ceramic, and the flange portion 20 may be formed from a metal such as aluminum and attached thereto.

This application claims priority based on Japanese Patent Application No. 2016-022982 filed with the Japan Patent Office on Feb. 9, 2016, Japanese Patent Application No. 2016-022983 filed with the Japan Patent Office on Feb. 9, 2016, and Japanese Patent Application No. 2016-128126 filed with the Japan Patent Office on Jun. 13, 2016, the entire contents of which are incorporated into this specification.

What is claimed is:

1. A multipoint spark plug configured to ignite an air-fuel mixture in a combustion chamber of an engine, comprising:

a main body portion formed in a flattened shape, the main body portion being inserted into an insertion hole of the engine such that a tip end portion thereof opposes the combustion chamber;

an electrode holding portion provided on the tip end portion; and electrodes held by the electrode holding portion, the electrodes projecting into the combustion chamber from the electrode holding portion so as to form a plurality of ignition gaps, wherein the electrodes include side electrodes and an intermediate electrode, the side electrodes being provided in a pair and disposed via a gap in a lengthwise direction of the tip end portion, the intermediate electrode being provided in the gap between the pair of side electrodes such that the plurality of ignition gaps are formed in the lengthwise direction of the tip end portion, and the electrode holding portion is formed from separate parts that hold the side electrodes and the intermediate electrode, respectively, so as to insulate the side electrodes and the intermediate electrode from the main body portion, the electrode holding portion projecting into the combustion chamber from the tip end portion.

2. The multipoint spark plug according to claim 1, wherein the intermediate electrode is provided in a plurality, and the electrode holding portion includes a pair of side electrode holding portions and a plurality of intermediate electrode holding portions, the pair of side electrode holding portions projecting into the combustion chamber from the tip end portion, the pair of side electrode holding portion holding the respective side electrodes so as to insulate the side electrodes from the main body portion, the plurality of intermediate electrode holding portions projecting into the combustion chamber from the tip end portion, the plurality of intermediate electrode holding portions being formed separately so as to hold the respective intermediate electrodes while insulating the intermediate electrodes from the main body portion.

3. The multipoint spark plug according to claim 2, wherein the intermediate electrode holding portions each hold one of the plurality of intermediate electrodes, the intermediate electrode holding portions being therefore provided in an identical number to the intermediate electrodes.

4. The multipoint spark plug according to claim 3, wherein a total surface area within the combustion chamber of one of the side electrodes and the side electrode holding portion that holds the side electrode is set to be larger than a total surface area within the combustion chamber of one of the intermediate electrodes and the intermediate electrode holding portion that holds the intermediate electrode.

5. A multipoint spark plug manufacturing method for manufacturing the multipoint spark plug according to claim 1, comprising: setting a heat range by varying the surface area within the combustion chamber of at least one of the electrodes and the electrode holding portions.

6. The multipoint spark plug manufacturing method according to claim 5, comprising: setting the surface areas within the combustion chamber of the electrode holding portions by varying projection lengths of the electrode holding portions.

7. The multipoint spark plug manufacturing method according to claim 5, comprising: setting the surface areas within the combustion chamber of the electrodes by varying projection lengths of the electrodes.

8. The multipoint spark plug manufacturing method according to claim 6, comprising: setting the surface areas within the combustion chamber of the electrodes by varying projection lengths of the electrodes.

9. The multipoint spark plug manufacturing method according to claim 5, comprising: setting the surface areas within the combustion chamber of the electrode holding portions by varying projection widths of the electrode holding portions.

10. The multipoint spark plug manufacturing method according to claim 6, comprising: setting the surface areas within the combustion chamber of the electrode holding portions by varying projection widths of the electrode holding portions.

11. The multipoint spark plug manufacturing method according to claim 7, comprising: setting the surface areas within the combustion chamber of the electrode holding portions by varying projection widths of the electrode holding portions.

12. The multipoint spark plug manufacturing method according to claim 8, comprising: setting the surface areas within the combustion chamber of the electrode holding portions by varying projection widths of the electrode holding portions.

* * * * *